US008857941B2

(12) United States Patent
Ebisawa

(10) Patent No.: US 8,857,941 B2
(45) Date of Patent: Oct. 14, 2014

(54) INK DISCHARGE AMOUNT ADJUSTER FOR EACH COLOR OF LINE INKJET PRINTER

(75) Inventor: Takashi Ebisawa, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 75 days.

(21) Appl. No.: 13/238,771

(22) Filed: Sep. 21, 2011

(65) Prior Publication Data

US 2012/0075375 A1 Mar. 29, 2012

(30) Foreign Application Priority Data

Sep. 24, 2010 (JP) ..... P2010-213892

(51) Int. Cl.
*B41J 2/205* (2006.01)
*B41J 2/21* (2006.01)

(52) U.S. Cl.
CPC ..... *B41J 2/2146* (2013.01); *B41J 2/2139* (2013.01); *B41J 2202/20* (2013.01); *B41J 2202/21* (2013.01)
USPC ..... 347/15; 347/10; 347/13; 347/14; 347/19; 347/42

(58) Field of Classification Search
CPC ..... B41J 2/2146
USPC ..... 347/15
See application file for complete search history.

(56) References Cited

U.S. PATENT DOCUMENTS

2005/0156975 A1* 7/2005 Inoue ..... 347/13
2009/0262158 A1* 10/2009 Sasayama ..... 347/14
2011/0285780 A1* 11/2011 Yamada et al. ..... 347/15

FOREIGN PATENT DOCUMENTS

JP 09-239971 A 9/1997
JP 2006-168241 A 6/2006

* cited by examiner

*Primary Examiner* — Manish S Shah
*Assistant Examiner* — Jeffrey C Morgan
(74) *Attorney, Agent, or Firm* — Nath, Goldberg & Meyer; Jerald L. Meyer

(57) ABSTRACT

Displacement information indicating a displacement amount of landing position in a main scanning direction of ink droplets discharged respectively from the nozzle of the head module of the same array of the line head of each color is acquired for each head module of the same array (steps S5, S7). Based on the displacement information and concentration information for each array, a color degree of an image when the discharge amount of ink droplets discharged from a nozzle of a head module of each color is not adjusted is specified for each head module of each array (step S9). A correction voltage value of a drive signal for the discharge of the nozzle of the head module of each color, which is suitable to return the specified color degree to "0", is calculated (step S11) and each corresponding nozzle is driven by the drive signal of the correction voltage value.

6 Claims, 11 Drawing Sheets

| | HEAD ARRAY 1 | HEAD ARRAY 2 | HEAD ARRAY 3 | • • • |
|---|---|---|---|---|
| DISPLACEMENT AMOUNT IN MAIN SCANNING DIRECTION | 0 μm | 40 μm | 20 μm | • • • |

| | HEAD ARRAY 1 | HEAD ARRAY 2 | HEAD ARRAY 3 | • • • |
|---|---|---|---|---|
| DISPLACEMENT AMOUNT IN MAIN SCANNING DIRECTION | 0 μm | 40 μm | 20 μm | • • • |

| | HEAD ARRAY 1 | HEAD ARRAY 2 | HEAD ARRAY 3 | • • • |
|---|---|---|---|---|
| M CONCENTRATION | 0.5 | 0.6 | 0.5 | • • • |
| K CONCENTRATION | 0.6 | 0.5 | 0.5 | • • • |

| RED DEGREE | HEAD ARRAY 1 | HEAD ARRAY 2 | HEAD ARRAY 3 |
|---|---|---|---|
| CONCENTRATION INFORMATION | -1 | 1 | 0 |
| DISPLACEMENT INFORMATION | 0 | 4 | 2 |
| TOTAL RED DEGREE | -1(BLACK) | 5(RED) | 2(SLIGHTLY RED) |

| CORRECTION VOLTAGE | HEAD ARRAY 1 (REDDEN) | HEAD ARRAY 2 (BLACKEN) | HEAD ARRAY 3 (SLIGHTLY BLACKEN) |
|---|---|---|---|
| M HEAD | +1(RAISE) | -2(LOWER) | -1(LOWER) |
| K HEAD | -2(LOWER) | +2(RAISE) | +1(RAISE) |

| HEAD ARRAY | 1 HEAD | 2 HEAD | 3 HEAD |
|---|---|---|---|
| COLOR DEGREE INFORMATION (RED DEGREE FOR MK) | -1 (BLACK) | 5 (RED) | 2 (SLIGHTLY RED) |
| CORRECTION CURVE FOR K | -2 LEVEL (LIGHT) | 1 LEVEL (DEEP) | NO CORRECTION |
| CORRECTION CURVE FOR M | 2 LEVEL (DEEP) | -1 LEVEL (LIGHT) | NO CORRECTION |

INK DISCHARGE AMOUNT ADJUSTER FOR EACH COLOR OF LINE INKJET PRINTER

BACKGROUND OF THE INVENTION

1. Technical Field

The present invention relates to a line inkjet printer performing printing with ink discharged from each nozzle of a plurality of head modules configuring a line head and, more particularly, to a line inkjet printer having a plurality of line heads for each color.

2. Background Arts

In the field of the inkjet printer, the line inkjet printer having enabled realization of fast printing by performing so-called one-path printing in a sheet-width direction of a print sheet (main scanning direction) becomes popular. In the line inkjet printer, a line head configured by arranging a plurality of head modules side by side in the main scanning direction is used. In particular, in a line inkjet printer performing color printing with ink of a plurality of colors, a plurality of line heads for each color is provided.

The line head of each color is attached to a common head holder at intervals in a transfer direction of a print sheet (sub scanning direction) and driven at shifted timings according to the intervals. Due to this, ink droplets of each color land on the same pixel of the print sheet in an overlapping manner.

Consequently, if there exists a displacement in the attachment position with respect to the head holder in any of the head modules in the line head of each color having a nozzle corresponding to a certain pixel, the ink droplets of each color land on the corresponding pixel being displaced but not overlapped with each other. If the landing positions of the ink droplets of each color are displaced, there occurs a trouble that the color of the pixel becomes a color different from the original color. The trouble that the landing positions of the ink droplets of each color are displaced from one another in a certain pixel occurs also when there is a difference in the discharge direction characteristics of ink droplets between the head modules of each color.

In order to solve the displacement in the landing position of the ink droplets of each color, in Japanese Patent Laid-Open No. 09-239971, a so-called multipass inkjet printer is proposed, in which the head reciprocates on the carriage. In this proposal, date about the characteristics of landing position of ink droplet by the orifice plate of the head of each color incorporated in the base of the carriage is given and the discharge operation is performed using the date so that the ink droplet lands on the correct position.

However, taking similar measures in a line inkjet printer having a remarkably larger number of nozzles requires a tremendously large configuration and an enormous amount of processing, and therefore, it is impractical.

On the other hand, Japanese Patent Laid-Open No. 2006-168241A has proposed measures when there is a displacement between the discharge directions of ink droplets of two nozzles neighboring across two head modules of the same line head in a line inkjet printer. However, this proposal only prevents the occurrence of light and deep stripes on an image printed by monochrome printing and does not serve as measures against the change in color in multicolor printing.

SUMMARY OF THE INVENTION

The present invention has been made in view of the above-mentioned circumstances and has an object to provide a discharge amount adjuster for each color of a line inkjet printer capable of effectively suppressing the change in color of an image caused by a configuration in which each line head of each color includes a plurality of head modules in a line inkjet printer.

In order to achieve the above-mentioned object, as an embodiment of the present invention, there is provided an ink discharge amount adjuster for each color of a line inkjet printer comprising: a plurality of line heads which includes head modules arranged side by side in a plurality of arrays in a print scanning direction intersecting a transfer direction of a print sheet and which is configured to discharge ink droplets of a color different for each line head from a number of nozzles provided in each head module of each line head; a displacement information setter in which displacement information indicating a displacement amount in the print scanning direction of dots of each color formed on the same pixel of the print sheet respectively by ink droplets of each color discharged from a nozzle of a head module of each line head is set for each of the head modules of each line head arranged in the same array in the transfer direction; a correction contents determiner configured to determine, for each color, correction contents of a discharge amount of ink droplets discharged respectively from the nozzle of the head module of each line head arranged in the same array in order to reduce a color difference between each array of dots formed respectively on each pixel of the print sheet based on the displacement information set in the displacement information setter; and a discharge amount corrector configured to correct the discharge amount of ink droplets from the nozzle of the head module of each line head arranged in the same array by the correction contents determined for each color by the correction contents determiner.

DESCRIPTION OF EMBODIMENTS

Hereinafter, embodiments of the present invention are explained with reference to the drawings. In each drawing, the same or equivalent symbol is attached to the same or equivalent region or component and its explanation is omitted or simplified.

Figure 1:
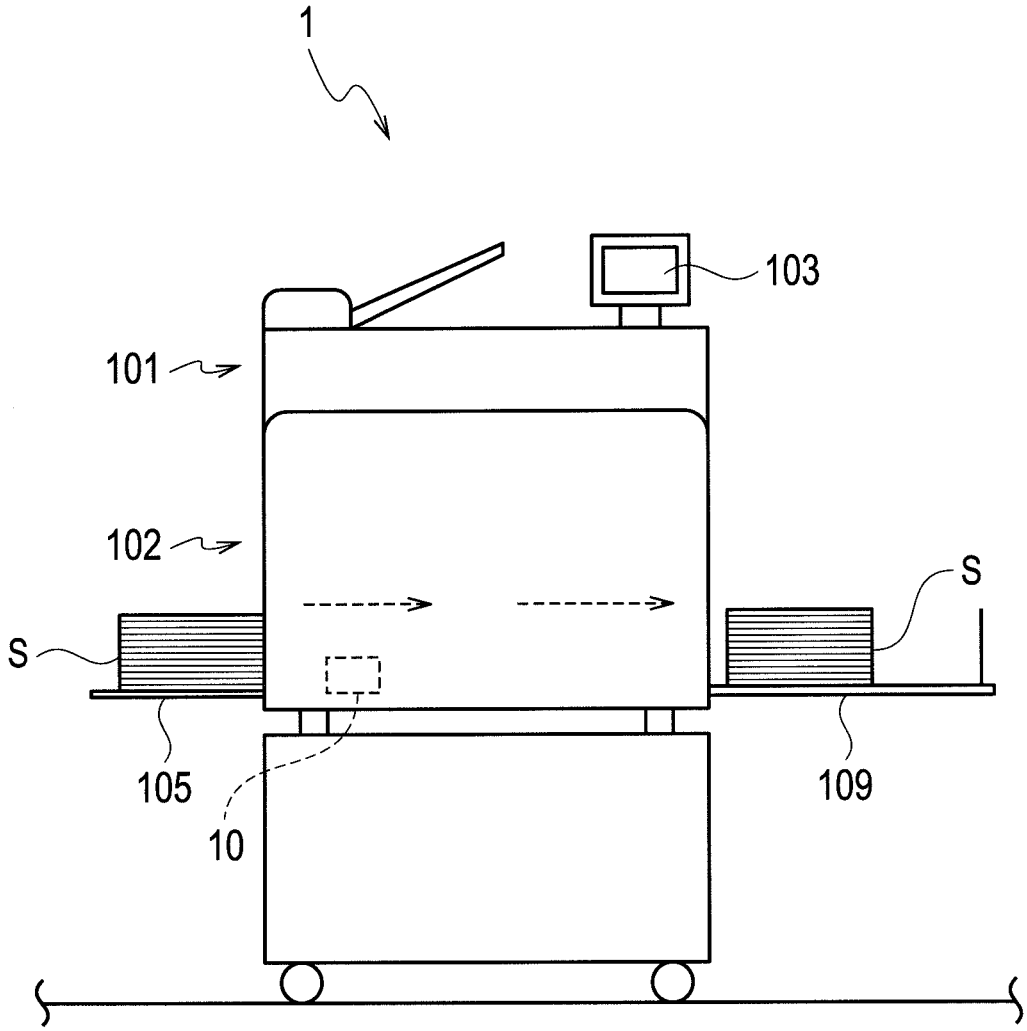
FIG. 1 is an explanatory diagram showing an outline configuration of a line inkjet printer to which the present invention is applied.

FIG. 1 is an explanatory diagram showing an outline configuration of a line inkjet printer to which the present invention is applied. A line inkjet printer (hereinafter, inkjet printer) 1 in the present embodiment comprises a scanner section 101 configured to read a document image on a document and output an image signal, a printer section 102 configured to print (record) a document image on a print sheet S (one-side or double-side) based on the image signal output from the scanner section 101, a display 103 used to display various displays and input, and a control unit 10 for total control. The print sheet S is transferred from a paper feed section 105 to a paper discharge section 109 via the printer section 102.

Figure 2:
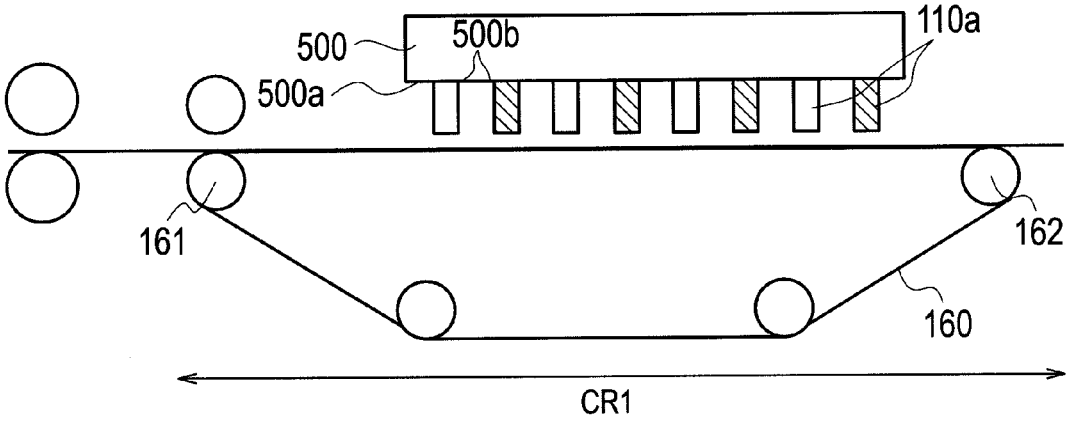
FIG. 2 is an explanatory diagram showing a printer section shown in FIG. 1 from the lateral side.
Figure 3A:
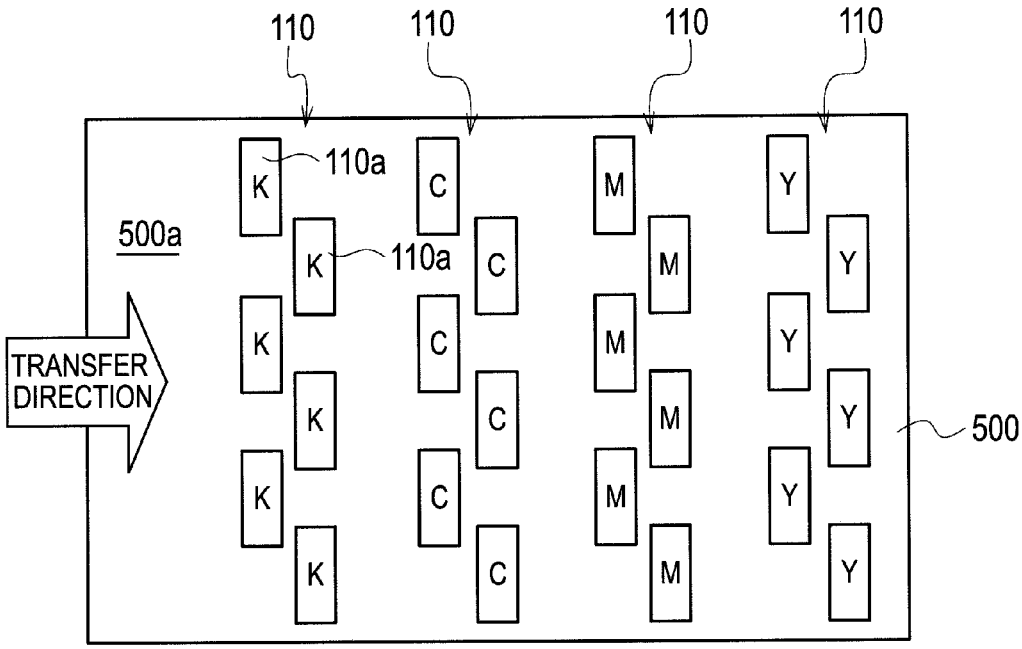
FIG. 3A is an explanatory diagram showing a head holder in FIG. 2 from under and FIG. 3B is an explanatory diagram showing a side section of the head holder in an enlarged view.
Figure 3B:
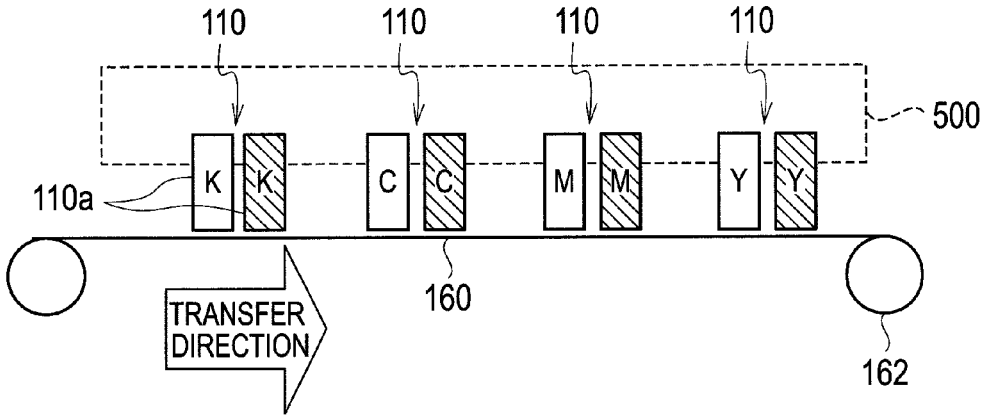

FIG. 2 is an explanatory diagram showing an image formation path CR1 in which an image is formed from the lateral side in the printer section 102 of the line inkjet printer 1 according to the present invention, FIG. 3A is an explanatory diagram showing a head holder 500 in FIG. 2 from under, which is arranged above the image formation path CR1, and FIG. 3B is an explanatory diagram showing a side section of the head holder 500 in an enlarged view.

The printer section 102 has a line head 110, which is an image forming section, for each color. The line head 110 of each color is configured by arranging a plurality of head modules 110*a* side by side in a print scanning direction (main scanning direction) perpendicular to a transfer direction of the print sheet S (sub scanning direction).

As shown in FIG. 2, the inkjet printer 1 according to the present embodiment includes the image formation path CR1 as its transfer path and through the image formation path CR1, the print sheet S is transferred at a speed determined by print conditions by a platen belt 160. Above the image formation path CR1, the line head 110 of each color is arranged in opposition to the platen belt 160 and from a nozzle of each head module 110*a* provided in the line head 110, ink of each color is discharged in units of lines to the print sheet S on the platen belt 160 and a plurality of images is formed in an overlapping manner.

To state in detail, the image formation path CR1 includes the platen belt 160, which is a transfer belt with no end, a drive roller 161, which is a drive mechanism of the platen belt 160, a driven roller 162, etc. Above the image formation path CR1, the head holder 500 is provided and at the head holder 500, the head module 110*a* of the line head of each color is held.

The platen belt 160 is moved circularly by the driven roller 161 and transfers the print sheet S in a range in opposition to the head module 110*a*. Specifically, the platen belt 160 is hooked between a pair of the drive roller 161 and the driven roller 162 arranged perpendicular to the transfer direction and by the drive force of the drive roller 161, the platen belt 160 is circled in the transfer direction.

The head holder 500 is a box-shaped body having a head holder surface 500*a* as a bottom surface and holds and fixes the head module 110*a* of the line head 110 of each color and at the same time, turns other functional sections configured to discharge ink from the module 110*a* into a unit and accommodates it. Further, the head holder surface 500*a*, which is the bottom surface of the head holder 500, is arranged in opposition to and in parallel with the transfer path. In the head holder surface 500*a*, a plurality of attachment openings 500*b* is arranged. Each attachment opening 500*b* is formed into the same shape as the horizontal section of the head module 110*a*. The plurality of the head modules 110*a* is inserted into each of the attachment openings 500*b*, respectively, and the discharge outlet is caused to protrude from the head holder surface 500*a*.

As shown in FIGS. 3A and 3B, the head module 110*a* is provided in a plural number for each color, that is, K (black), C (cyan), M (magenta), and Y (yellow). The head module 110*a* of each color is arranged with a space in between in the transfer direction (sub scanning direction). The plurality of the head modules 110*a* of each color is arranged side by side in the print scanning direction (main scanning direction) and arranged in positions shifted in the transfer direction for every two head modules. Due to this, the separation between nozzles (not shown schematically) at the farthest ends of the two neighboring head modules 110*a* is caused to agree with the separation between the neighboring nozzles of each head module 110*a*. In the following explanation, each head module 110*a* of each line head 110 is referred to as the "first array", "second array", "third array", . . . in the order of alignment in the print scanning direction.

It is possible for each head module 110*a* to change the number of ink drops to be discharged. The concentration of dots changes depending on the number of ink droplets to be discharged. The inkjet printer 1 in the present embodiment comprises a function to adjust the size of a drop as the amount of droplets. It is possible to adjust the amount of droplets in the head module 110*a* by adjusting the drive voltage of the head module 110*a*.

As explained above with reference to FIG. 2, the head module 110*a* of the line head 110 of each color is attached to the common head holder 500. If the attachment position of the head module 110*a* with respect to the head holder 500 is displaced, in a pixel on the print sheet S on which ink droplets discharged from the nozzle of the head module 110*a* land, the color changes from the original color. Consequently, there is produced a difference in color from a pixel on the print sheet S on which ink droplets discharged from the nozzle of the other head module 110*a* the attachment position of which is not displaced land.

Figure 4:
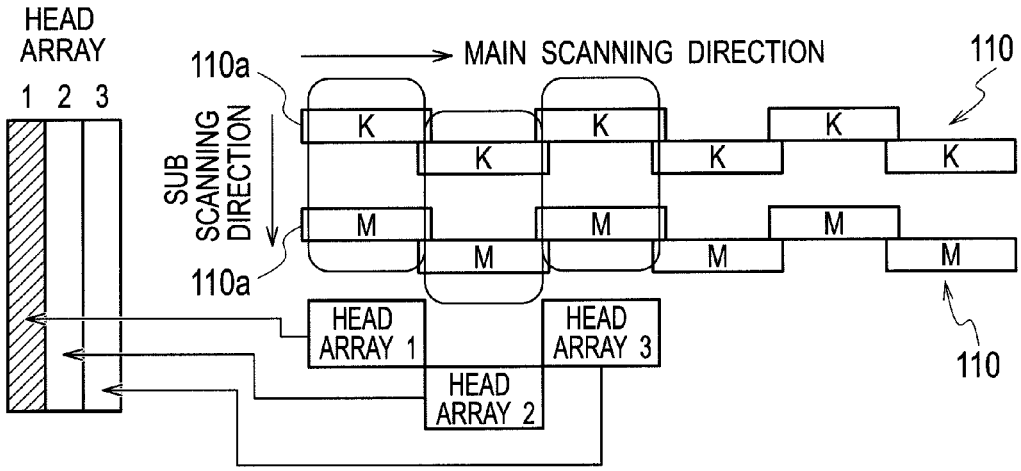
FIG. 4 is an explanatory diagram showing a state of a difference in color produced in an image on a print sheet when a head module is attached to the head holder in FIG. 2 in a displaced position.

FIG. 4 is an explanatory diagram showing a state of a difference in color produced in an image on the print sheet S when the head module 110*a* is attached to the head holder 500 in a displaced position. In order to make explanation easy, in FIG. 4, the line heads 110 for two colors are excerpted.

For example, it is supposed that in the second array (head array 2) and the third array (head array 3) shown on the right side in FIG. 4, the attachment position of the head module 110*a* of one of the line heads 110 is displaced. In this case, as shown on the left side in the diagram, the color of the image of the pixel part on the print sheet S corresponding to the second array and the third array changes into a color different from the correct color of the image of the pixel part corresponding to the first array and there is produced a difference in color therebetween. Such a difference in color is caused because the landing position of the ink droplets discharged from the nozzle of the head module 110*a* on the print sheet S is displaced from the correct pixel position caused by the displacement in the attachment position of the head module 110*a*.

Figure 5:
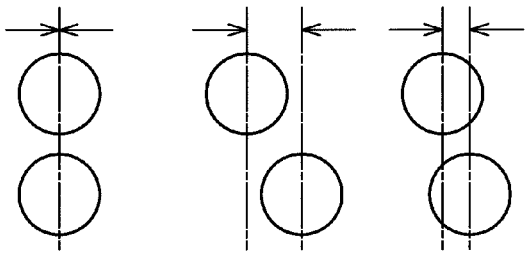
FIG. 5 is an explanatory diagram showing a state of a displacement in landing position of ink droplet when a head module is attached to the head holder in FIG. 2 in a displaced position.

FIG. 5 is an explanatory diagram showing a state of a displacement in the landing position of the ink droplet when the head module 110*a* is attached to the head holder 500 in FIG. 2 in a displaced position. In FIG. 5, in order to make the diagram easy-to-see, the dots of ink droplets of two colors discharged from each nozzle of the head module 110*a* of the same array of the two line heads 110 to the same pixel are shown displaced in the vertical direction of the diagram. Consequently, in FIG. 5, the positions of the two dots in the horizontal direction of the diagram represent the presence/absence of the displacement in the landing position of the ink droplet in the print scanning direction (main scanning direction).

Then, if the head module 110*a* of each color is attached to the head holder 500 without displacement in the print scanning direction (main scanning direction), as illustrated as a case of the head module 110*a* of the first array in FIG. 5, the ink droplets of two colors discharged respectively from the head modules 110*a* of the same array land on the same position on the print sheet S.

However, if the head module 110*a* the attachment position of which to the head holder 500 is displaced in the print scanning direction (main scanning direction) exists, the landing positions of the ink droplets of two colors discharged respectively from the head modules 110*a* of the same array are displaced from each other in the main scanning direction of the print sheet S.

For example, in the case of the head module 110*a* of the second array illustrated in FIG. 5, because of the displacement in the attachment position of the head module 110*a* of a certain color, a displacement of 40 μm in the same main scanning direction of the displacement in the attachment position is produced between the landing positions of the ink droplets of two colors. In the case of the head module 110*a* of the third array, a case is illustrated where the landing positions of the ink droplets of two colors are displaced from each other by 20 μm in the main scanning direction because of the displacement in the attachment position of the head module 110*a* of a certain color.

The displacement in the landing position of ink droplet described above is the cause of the difference in color shown in FIG. 4. For example, when the line heads 110 in FIG. 4 and the ink droplets in FIG. 5 are those for K (black) and M (magenta), if the landing positions of the ink droplets are displaced, the color changes from the original black color into a red color.

The change (difference) in color of an image resulting from the displacement in the attachment position of the head module 110*a* of each line head 110 is explained as above. However, the difference in color of an image is produced also when there is a difference in concentration of dots by ink droplets discharged from the nozzle between the head module 110*a* of each array configuring each line head 110.

Figure 6:
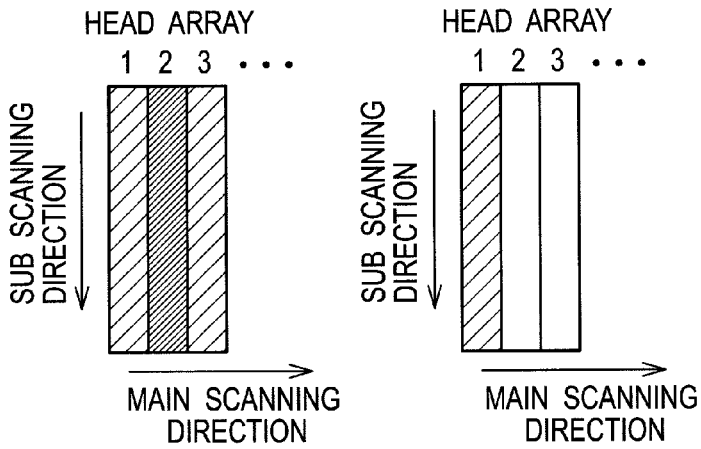
FIG. 6 is an explanatory diagram showing a state where there is a difference in concentration of dots by ink droplets discharged from a nozzle between a plurality of head modules configuring one head line shown in FIG. 3.

FIG. 6 is an explanatory diagram showing a state where there is a difference in concentration of dots by ink droplets discharged from nozzles between a plurality of the head modules 110*a* configuring one of the line heads 110. For example, a case is supposed where there exists a difference in concentration of dots by ink droplets discharged from nozzles in the line head 110 of M (magenta) illustrated in the table at the upper side in FIG. 6, such as a difference in which while the concentration in the first array (head array 1) and the third array (head array 3) is 0.5 (units are omitted), the concentration in the second array (head array 2) is 0.6. In this case, when an image is printed on the print sheet S in monochrome printing of magenta, there is produced a difference in concentration as shown on the lower-left side in FIG. 6 between the pixel parts corresponding to each of the head modules 110.

Similarly, a case is supposed where there exists a difference in concentration of dots by ink droplets discharged from nozzles in the line head 110 of K (black) illustrated in the table at the upper side in FIG. 6, such as a difference in which while the concentration in the second array (head array 2) and the third array (head array 3) is 0.5 (units are omitted), the concentration in the first array (head array 1) is 0.6. In this case, when an image is printed on the print sheet S in monochrome printing of black, there is produced a difference in concentration as shown on the lower-left side in FIG. 6 between the pixel parts corresponding to each of the head modules 110*a*.

In such a case where there is a difference in concentration of dots between the pixel parts corresponding to each of the head modules 110*a* of the same color, when composite printing with another color is performed, there is produced a difference in color between the pixel parts corresponding to each of the head modules 110*a*.

Figure 7:
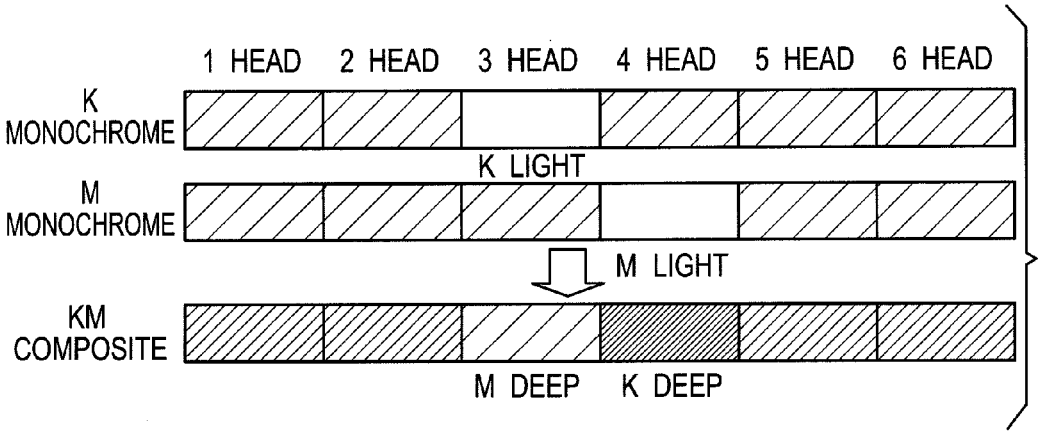
FIG. 7 is an explanatory diagram showing a state of a difference in color produced on a print sheet when two-color composite printing is performed using colors different in the dot concentration between head modules as shown in FIG. 6.

FIG. 7 is an explanatory diagram showing a state of a difference in color produced in an image on the print sheet S when two-color composite printing is performed using colors with a difference in concentration of dots between the pixel parts corresponding to each of the head modules 110*a*.

As illustrated in the first row in FIG. 7, here, it is supposed that the dot concentration of the pixel part corresponding to the head module 110*a* of the third array (third head) is lower compared to the dot concentration of the pixel parts corresponding to the head modules 110*a* of the other arrays in the line head 110 of K (black). Further, as illustrated in the second row in FIG. 7, it is supposed that the dot concentration of the pixel part corresponding to the head module 110*a* of the fourth array (fourth head) is lower compared to the dot concentration of the pixel parts corresponding to the head modules 110*a* of the other arrays in the line head 110 of M (magenta).

When two-color composite printing is performed using the line head 110 of K (black) and the line head 110 of M (magenta) with the difference in the dot concentration described above, in the pixel part corresponding to the head module 110*a* of the third array on the printed image, the color of M (magenta) becomes conspicuous and in the pixel part corresponding to the head module 110*a* of the fourth array, the color of K (black) becomes conspicuous as shown in the third row in FIG. 7.

As explained above, when the displacement in the attachment position of the head module 110*a* to the head holder 500 or the variation in the dot concentration between the head modules 110*a* of the same color exist, a part is produced where the color of the image changes from the original color into a different one, and therefore, the quality of the image is impaired.

In view of the above, in the inkjet printer 1 in the present embodiment, the control unit 10 is configured to adjust the discharge amount of ink droplets discharged from a nozzle of each head module 110*a* according to the displacement in the attachment position of the head module 110*a* to the head module 110 or the variation in the dot concentration between the head modules 110*a* of the same color.

Figure 8:
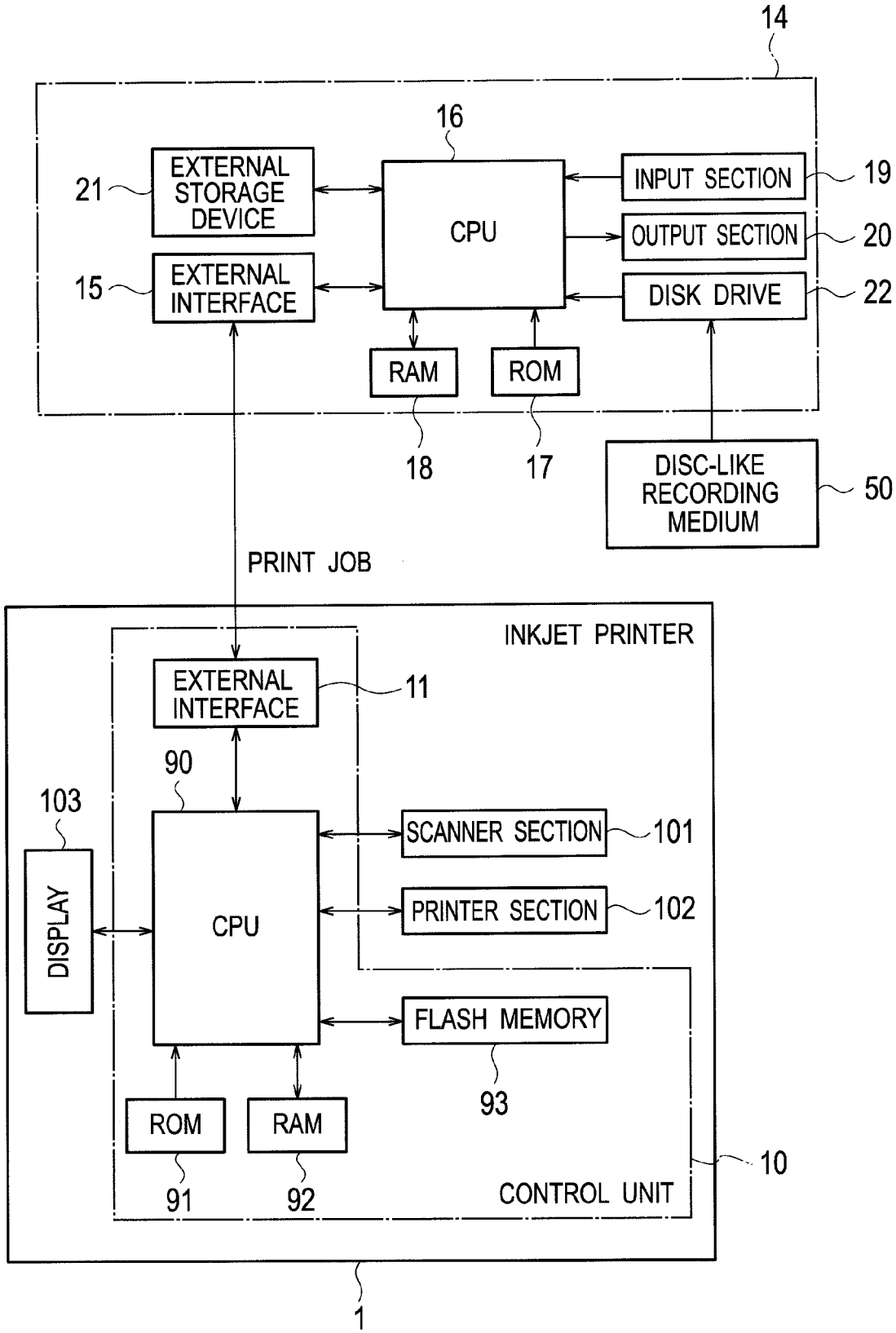
FIG. 8 is a block diagram showing a configuration of a control system of the line inkjet printer in FIG. 1.

FIG. 8 is a block diagram showing an electrical configuration of the control unit 10 in FIG. 1. As shown in FIG. 8, to the control unit 10, an external interface 15 of a client terminal 14, to be described later, is connected via an external interface 11. For this connection, for example, 100BASE-TX wired LAN is used. The control unit 10 receives a print job of a document image from the client terminal 14. The print job includes PostScript data and print environment data. The control unit 10 generates raster data of the document image from the PostScript data of the received print job. The inkjet printer 1 performs printing of the document image on the print sheet S in the printer section 102 under conditions specified in print environment information of the print job.

To a CPU 90 of the control unit 10, the display 103 is connected. The display 103 is arranged on the top part of the inkjet printer 1 as shown in FIG. 1. When the inkjet printer 1 is used in a scanner mode in which an image is read from the print sheet S by the scanner section 101, it is possible to utilize the display 103 as an input operation section to turn the read image into electronic data or to which a user selects and inputs a menu, such as self-diagnosis.

The control unit 10 of the inkjet printer 1, which causes the above-described printer section 102 to perform printing operation, comprises the CPU 90 as shown in FIG. 8. The CPU 90 controls the operation of the scanner section 101 and the printer section 102 according to the contents input and set from the display 103 based on programs and set information stored in a ROM 91.

In the control unit 10, a RAM 92 is provided and in the RAM 92, contents of menu selection etc. input from the display 103 are stored at any time. In the RAM 92, a frame memory region is provided. In the frame memory region, the raster data of the document image generated by the CPU 90 from the PostScript data of the pint job input from the client terminal 14 to the control unit 10 is stored temporarily until it is output to the printer section 102.

Further, in the control unit 10, a flash memory 93 is provided. The flash memory 93 is a nonvolatile memory capable of holing stored contents even if power supplied to the inkjet printer 1 is cut off. In the flash memory 93, a color matching system and a printer engine of the display section 103, the printer section 102 and firmware of the scanner section 101 are stored in regions separated for their use, respectively.

The client terminal 14 is configured by a PC (personal computer) etc. and comprises a CPU 16 that executes various kinds of processing based on control programs stored in a ROM 17, a RAM 18 that functions as a working area of the CPU 16, an input section 19 configured by a keyboard, mouse, etc., and an output section 20 configured by a liquid crystal display etc.

To the CPU 16, besides the external interface 15 described above, an external storage device 21 and a disk drive 22 are connected. In the external storage device 21, a storage region of application programs to generate data of a document image, a storage region of printer driver programs of the inkjet printer 1, a database region of data of a document image generated using application programs, and a database region of the standard contents of print environment information in printer driver programs, contents customized by a user, etc., are secured. The print environment information is output to the control unit 10 as print information data in the print job.

The CPU 16 activates the application program in the external storage device 21 according to a request for activation input from the input section 19 and generates data of a document image of the contents specified by an input of parameter etc. from the input section 19 on the activated application program. The generated data of a document image is displayed and output in the output section 20 and when a request for saving is input from the input section 19, it is stored in the database region of data of a document image of the external storage device 21.

The data of a document image stored in the database region of the external storage device 21 is read from the external storage device 21 when a request for read is input from the section 19 during the activation of the application program. It is possible to display and output the read data of a document image in the output section 20 or to process it on the application program to regenerate it into new data of a document image.

Then, when an instruction to print is input from the input section 19 during the activation of the application program, the CPU 16 generates a print job of a document image to be printed and outputs the generated print job from the external interface 15 to the external interface 11 of the control unit 10. It is possible to output the print job to the control unit 10 by the CPU 16 executing the printer driver program stored in the external storage device 21.

Further, it is possible for the CPU 16 to read various programs and data from a disc-like recording medium 50, such as an optical disc, by the disk drive 22 of the client terminal 14 and to install (store) them in the external storage device 21 or to transmit to the side of the inkjet printer 1.

Next, the procedure when ink droplet discharge amount adjustment processing is performed on the side of the inkjet printer 1 in FIG. 1 is explained with reference to a flowchart in FIG. 9. The flowchart in FIG. 9 shows processing performed by the CPU 90 of the control unit 10 shown in FIG. 8 executing the program stored in the ROM 91.

Figure 9:
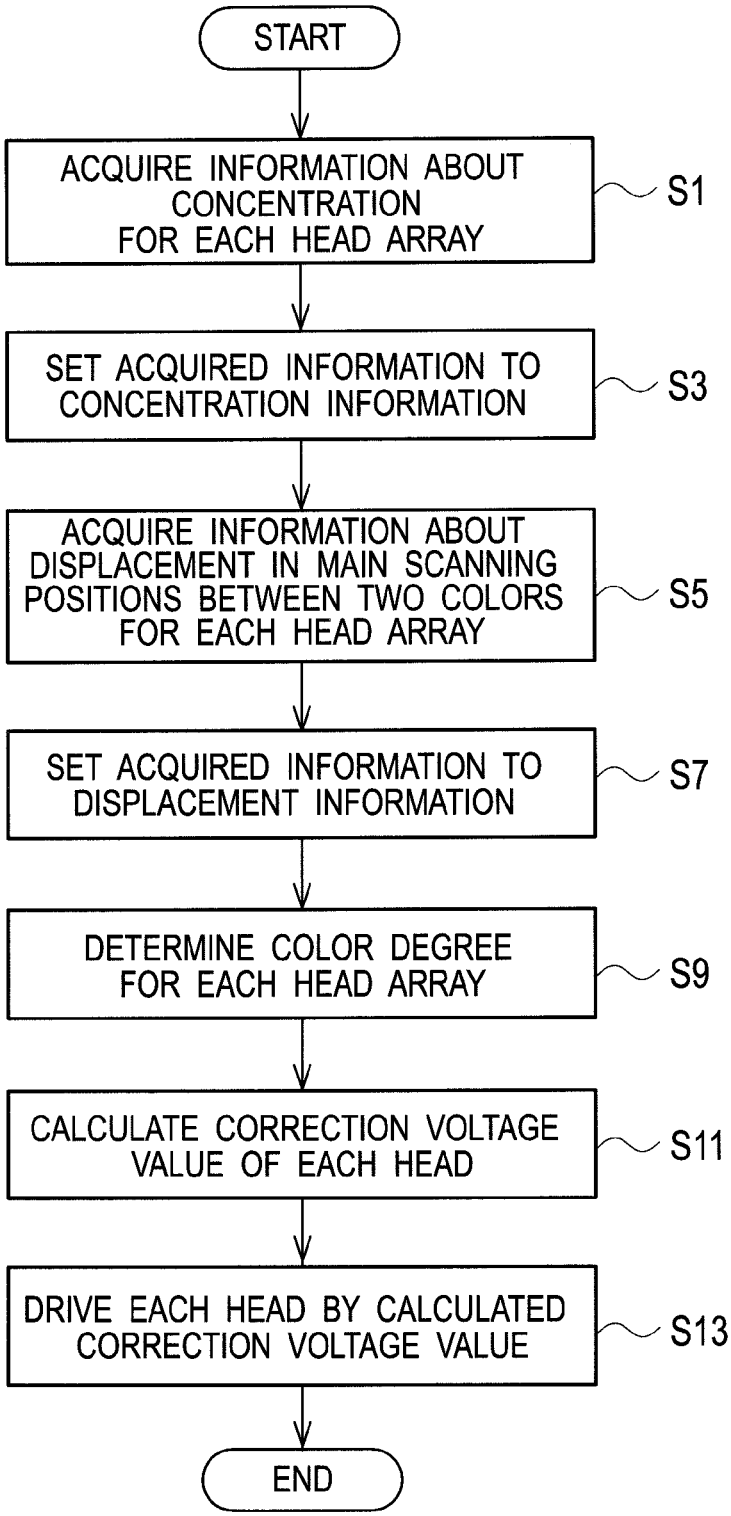
FIG. 9 is a flowchart showing a procedure when ink droplet discharge amount adjustment processing is performed on the side of the line inkjet printer in FIG. 1.

As shown in FIG. 9, first, the CPU 90 acquires concentration information indicating the concentration of dots by ink droplets discharged from the nozzle of the head module 110*a* for each head module 110*a* of the line head of each color (step S1) and sets the acquired concentration information as information about ink droplet discharge amount adjustment (step S3).

Further, the CPU 90 acquires displacement information indicative of the displacement amount in the landing position in the main scanning direction of ink droplets discharged respectively from the nozzle of the head module 110*a* of the same array of the line head 110 of each color for each head module 110*a* of the same array (step S5) and sets the acquired displacement information as information about ink droplet discharge amount adjustment (step S7).

Here, it is possible to perform acquisition of concentration information in step S1 and acquisition of displacement information in step S5 as follows. First, for example, by operating the display 103, a self-diagnosis menu of the scanner mode is selected and the inkjet printer 1 is caused to print a chart sheet.

Figures 10, 11:
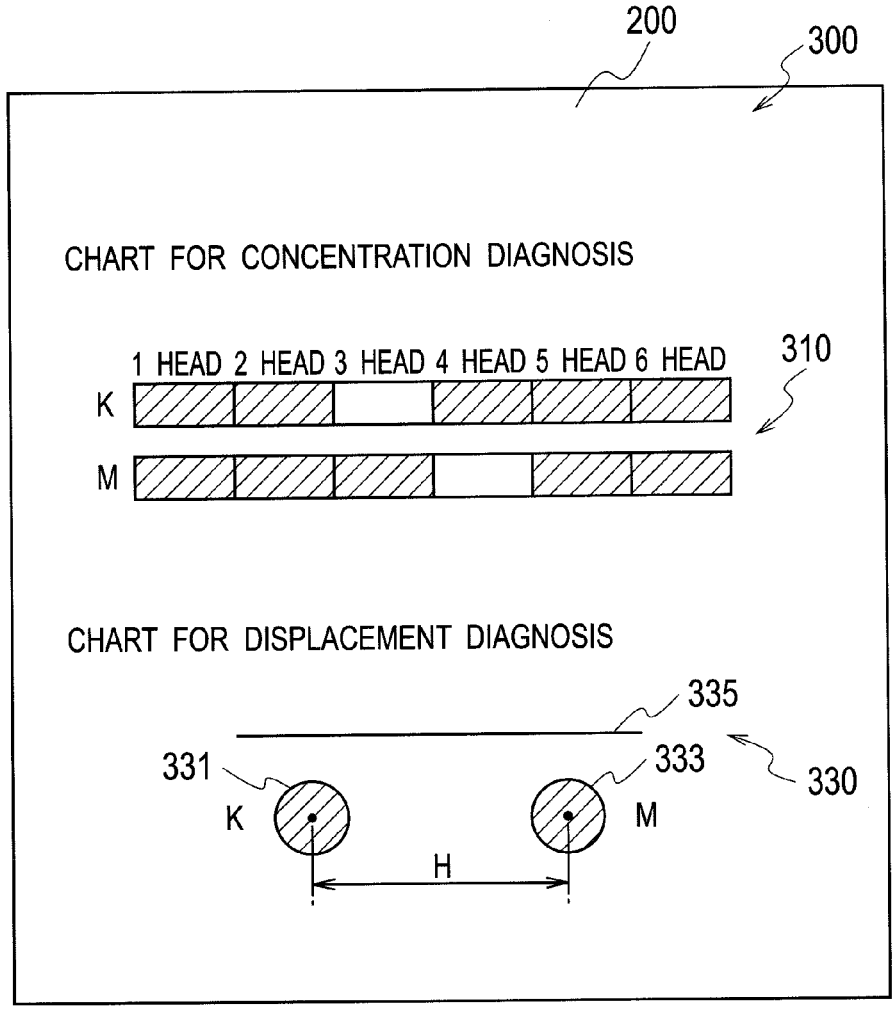
FIG. 10 is an explanatory diagram showing contents of a chart image of a chart sheet that can be printed by the line inkjet printer in FIG. 1 in order to utilize for acquisition of concentration information and displacement information shown in the flowchart in FIG. 9.
FIG. 11 is an explanatory diagram showing an example of a relationship between set contents of concentration information and displacement information shown in the flowchart in FIG. 9 and a color degree of an image specified based thereon.

FIG. 10 is an explanatory diagram showing the contents of a chart image on the printed chart sheet. As shown in FIG. 10, on a chart sheet 200, a chart image 300 including a concentration chart 310 including concentration information and a displacement chart 330 including displacement information is printed.

It is possible to form the concentration chart 310 into a band-like chart showing the result when ink droplets are caused to be discharged from the nozzle of each head module 110*a* configuring the line head 110 of each color, for example, as shown in the first row and the second row in FIG. 7, while controlling so that dots having the same concentration are formed. In FIG. 10, in order to make explanation easy, only two colors, that is, k (black) and M (magenta) are shown, however, the same chart is printed as the concentration chart 310 for C (cyan), Y (yellow), and other ink colors.

The displacement chart 330 is a chart to confirm whether or not the positions of dots by ink droplets discharged from the nozzle to the same pixel are relatively displaced between the head modules 110*a* of the same array in the line heads 110 of different colors. In FIG. 10, for the sake of simplification of explanation, a chart to confirm the presence/absence of a displacement in dot position between two colors, that is, K (black) and M (magenta) is shown. As a matter of course, the same chart is printed as the displacement chart 330 between two colors of C (cyan), Y (yellow), and other ink colors.

The displacement chart 300 includes dots 331, 333 by ink droplets discharged from nozzles in positions different from each other in the main scanning direction (print scanning direction) in the head modules 110*a* of the same array (for example, of the same first array, the same second array, the same third array, . . . ) of, for example, K (black) and M (magenta). That is, in the example shown in FIG. 10, the nozzle used to discharge ink droplets in the head module 110*a* of K (black) and the nozzle used to discharge ink droplets in the head module 110*a* of M (magenta) are displaced in the main scanning direction by an amount corresponding to two pitches.

If the dots by ink droplets from the nozzles in the same position in the main scanning direction (print scanning direction) in the head modules 110*a* of K (black) and M (magenta) of the same array are printed on the displacement chart 330, the most parts or the entire parts of both dots of K (black) and M (magenta) overlap each other, and therefore, it becomes difficult to determine whether both dots are in the same position or displaced in the main scanning direction.

Because of the above, in the present embodiment, the nozzles for K (black) and M (magenta) in the positions displaced in the main scanning direction by an amount corresponding to two pitches are used as the nozzles to discharge ink droplets of the dots 331, 333 to be printed on the displacement chart 300 by taking into consideration that the pitch of the nozzle in each head module 110*a* is the same. Then, it is made possible to determine whether the head modules 110*a* of K (black) and M (magenta) are attached respectively to the head holder 500 in the correct positions by confirming the positions of the dots 331, 333 on the displacement chart 300 depending on whether a separation H between both the dots 331, 333 in the main scanning direction agrees with the amount corresponding to the displacement in the main scanning direction between the nozzles from which the ink droplets of the dots 331, 333 are discharged.

Consequently, if the respective head modules 110*a* are attached to the head holder 500 in the correct positions, the separation H between the center of the dot 331 of K (black) and the center of the dot 333 of M (magenta) has a dimension equal to the displacement amount (that is, amount corresponding to two pitches in the example in FIG. 10) in the main scanning direction of the nozzles used to discharge the respective ink droplets. It is possible to determine whether there is a displacement in a direction other than the main scanning direction (that is, a direction including the component in the sub scanning direction) by, for example, determining whether or not the separations from a ruled line 335 indicative of the main scanning direction printed in the vicinity of the dots 331, 333 to the center of each of the dots 331, 333 are equal to each other.

It is possible to acquire concentration information from the contents of the concentration chart 310 and displacement information from the contents of the displacement chart 330, respectively, by reading the chart image 300 of the chart sheet 200 described above by the scanner section 101 and analyzing the contents of the read chart image 300 by the CPU 90.

It may also be possible to acquire information separately and set it by, for example, the input operation of the display 103 in step S3 and step S7 rather than acquiring concentration information and displacement information by causing the inkjet printer 1 to print the chart sheet 200 in FIG. 10 and reading it by the scanner section 101.

After acquiring concentration information and displacement information, respectively, in each head module 110*a* of each array and setting them, next, the color degree of an image when the discharge amount of ink droplets discharged from the nozzle of the head module 110*a* of each color is not adjusted is specified (determined) in each head module 110*a* of each array based on the set concentration information and displacement information (step S9).

FIG. 11 is an explanatory diagram showing an example of a relationship between the set contents of concentration information and displacement information set in step S3 and step S7 and the color degree of an image specified based thereon. In FIG. 11, a case where information is acquired using the chart sheet 200 in FIG. 10 is illustrated, and therefore, the set contents of concentration information and displacement information and the specified color degree (red degree) are shown in the relationship between K (black) and M (magenta).

Here, the set concentration information of the first array (head array 1) to the third array (head array 3) is set as "−1", "1", "0" ("0" means there is no difference in concentration), respectively, by level values indicative of the difference in concentration of the dot of M (magenta) from that of the dot of K (black). Further, the set displacement information of each array is set as "0", "4", "2" ("0" means there is no displacement), respectively, by level values indicative of the displacement amount in the main scanning direction between the dots of K (black) and M (magenta).

Then, the image formed by dots by ink droplets discharged from the nozzle of the head module 110*a* of the first array is specified (determined) to be the color degree (total red degree) of "−1 (black)" in step S9 in FIG. 9. This means that the concentration of the dot of M (magenta) is lower than the concentration of the dot of K (black) by one level and the dot of K (black) and the dot of M (magenta) are not displaced in the main scanning direction, and therefore, the change in the color degree (red degree) by "−1 (black)" level is produced by the difference in concentration between the dots.

Similarly, the image formed by dots by ink droplets discharged from the nozzle of the head module 110*a* of the second array is specified (determined) to be the color degree (total red degree) of "5 (red)" in step S9 in FIG. 9. This means that the concentration of the dot of M (magenta) is higher than the concentration of the dot of K (black) by one level and the dot of K (black) and the dot of M (magenta) are displaced in the main scanning direction by four levels, and therefore, the change in the color degree (red degree) by "5 (red)" level is produced by the difference in concentration and the displacement between the dots.

Further, the image formed by dots by ink droplets discharged from the nozzle of the head module 110*a* of the third array is specified (determined) to be the color degree (total red degree) of "2 (slightly red)" in step S9 in FIG. 9. This means that the concentration of the dot of K (black) and the concentration of the dot of M (magenta) are the same and the dot of K (black) and the dot of M (magenta) are displaced in the main scanning direction by two levels, and therefore, the change in the color degree (red degree) by "2 (slightly red)" level is produced by the displacement between the dots.

When specifying (determining) the color degree (total red degree) in step S9 from the concentration information and displacement information set in step S3 and step S7 in FIG. 9, it is possible to use a table that associates and defines both, a conversion formula to calculate the value of the color degree using the value of each piece of information, etc., after causing the RAM 92 to have them. It may, of course, be possible to specify (determine) by a method other than the above.

After specifying (determining) the color degree of the image when the discharge amount of ink droplets discharged from the nozzle of the head module 110*a* of each color is not adjusted in step S9 in FIG. 9, a numerical value to adjust the discharge amount of ink droplets discharged from the nozzle of the head module 110*a* of each color is determined, which is suitable to return the specified color degree (total red degree) to "0". In the present embodiment, a correction voltage value of a drive signal (discharge drive signal) used to drive the discharge of the nozzle is calculated as a numerical value to adjust the discharge amount on the assumption that the head module 110*a* has a nozzle of the shear mode type (step S11). It is possible to calculate the correction voltage value by using, for example, the table the RAM 92 is caused to have.

Figures 12, 13:
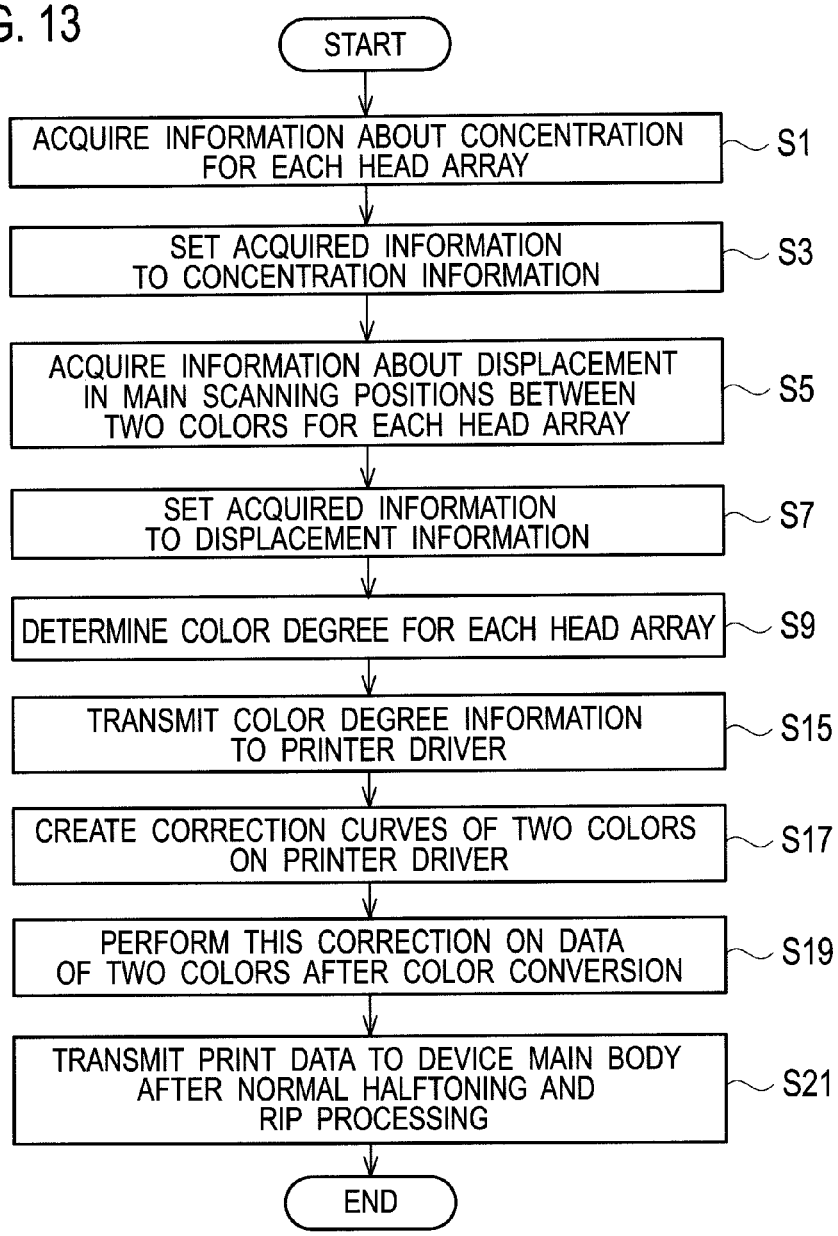
FIG. 12 is an explanatory diagram showing an example of a table associating the color degree of an image shown in the flowchart in FIG. 9 and contents of voltage correction of a nozzle drive signal.
FIG. 13 is a flowchart showing a procedure when part of ink droplet discharge amount adjustment processing is performed on the side of a client terminal in FIG. 8.

FIG. 12 is an explanatory diagram showing an example of a table that associates the color degree of an image and the contents of voltage correction of the drive signal of the nozzle, which can be referred to when calculating the correction voltage value of the drive signal of the nozzle of the head module 110*a* in step S11.

As shown in FIG. 12, as to the head module of the first array (head array 1), the result is that the total red degree is "−1 (black)" as shown in FIG. 11, and therefore, the correction contents are associated, in which the drive signal voltage for the nozzle of the head module 110*a* of M (magenta) is raised by "+1" level and the drive signal voltage for the nozzle of the head module 110*a* of K (black) is lowered by "−2" level so that the color degree (color) becomes red.

Similarly, as to the head module of the second array (head array 2), the result is that the total red degree is "5 (red)" as shown in FIG. 11, and therefore, the correction contents are associated, in which the drive signal voltage for the nozzle of the head module 110*a* of M (magenta) is lowered by "−2" level and the drive signal voltage for the nozzle of the head module 110*a* of K (black) is raised by "+2" level so that the color degree (color) becomes black.

Further, as to the head module of the third array (head array 3), the result is that the total red degree is "2 (slightly red)" as shown in FIG. 11, and therefore, the correction contents are associated, in which the drive signal voltage for the nozzle of the head module 110*a* of M (magenta) is lowered by "−1" level and the drive signal voltage for the nozzle of the head module 110*a* of K (black) is raised by "+1" level so that the color degree (color) becomes slightly black.

Then, in step S11 in FIG. 9, it is possible to calculate the correction voltage value of the drive signal for the nozzle of each of the head modules 110*a* of K (black) and M (magenta) by multiplying the level associated as the correction contents by a corrected value per unit level etc.

By implementing the correction contents described above, as to the head module 110*a* of the first array (head array 1), the concentration of the dot of K (black) decreases and the concentration of the dot of M (magenta) increases by half the magnitude of the decrease. As to the head module 110*a* of the second array (head array 2), the concentration of the dot of K (black) increases and the concentration of the dot of M (magenta) decreases by the same magnitude of the increase. Further, as to the head module 110*a* of the third array (head array 3) also, the concentration of the dot of K (black) increases by half the magnitude of the second array (head array 2) and the concentration of the dot of M (magenta) decreases by the same magnitude of that.

Even if the increase and decrease in the dot concentration as described above are caused by the correction, the difference in concentration of the dot of K (black) between each array and the difference in concentration of the dot of M (magenta) between each array do not increase from those before the correction. Consequently, it is possible to prevent the occurrence of a further change in the color degree due to the magnification of the difference in concentration of the dots of K (black) and M (magenta) between each array by performing the above-mentioned correction to return the color degree to the original one.

It is possible to continuously use the correction voltage value of the drive signal for the nozzle calculated in step S11 unless the head module 110*a* is replaced with another etc. Consequently, it is sufficient to perform once each procedure in step S1 to step S11 unless new circumstances, such as the replacement of the head module 110*a*, occur.

Then, each time the print job is input from the client terminal 14 and printing of an image by the print job is performed in the printer section 102, the CPU 90 drives the nozzles provided in the head modules 110*a* of the arrays corresponding to each of the head modules 110*a* of K (black) and M (magenta) respectively by the drive signal of the correction voltage value calculated in step S11 (step S13).

Each procedure shown in the flowchart in FIG. 9 explained above is performed in the inkjet printer 1 for the colors other than K (black) and M (magenta) described above. Then, the corresponding nozzle is driven by the drive signal of the calculated correction voltage value. By doing so, it is possible to effectively suppress the occurrence of a change in color in an image of a pixel by making it hard for the displacement in landing position to occur between ink droplets of each color for the same pixel even if the head module 110*a* attached to the head holder 500 in a displaced position exists in the head modules 110*a* of the same array in the line head 110 of each color.

Further, it is possible to effectively suppress the occurrence of a change in color in an image of a corresponding pixel by suppressing the difference in concentration even if the head module 110*a* of which the concentration of the dot formed by the discharge of ink droplets from the nozzle is different from that of the other head modules 110*a* exists in the line head 110 of each color.

When a printer server in which font data etc. is accumulated is provided between the client terminal 14 and the inkjet printer 1, it may also be possible to cause the printer server to perform each procedure shown in the flowchart in FIG. 9.

In the embodiment explained above, the adjustment of the ink droplet discharge amount is made by correcting the voltage of the nozzle drive signal on the side of the inkjet printer 1. However, it is also possible to cause the side of the client terminal 14 to perform correction to adjust the ink droplet discharge amount for the image data supplied as the print job to the inkjet printer 1 from the client terminal 14 having the printer driver capability.

Hereinafter, a modified embodiment of the present invention configured as described above is explained. In this modified embodiment also, the procedures for two colors, K (black) and M (magenta), are excerpted and explained in order to make explanation easy.

FIG. 13 is a flowchart showing a procedure when part of the ink droplet discharge amount adjustment processing is performed on the side of the client terminal 14 in FIG. 8. In the present embodiment, as shown in FIG. 13, step S1 to step S9 relating to acquisition and setting of concentration information and displacement information are performed by the control unit 10 of the inkjet printer 1 and the subsequent procedure is performed by the client terminal 14.

Then, the CPU 90 of the control unit 10 transmits the color degree (total red degree) of K (black) and M (magenta) specified (determined) for each head module 110*a* of each array to the CPU 16 of the client terminal 14 having the printer driver capability (step S15).

Next, based on the received color degree (total red degree) of K (black) and M (magenta) for each head module 110*a* of each array, the CPU 16 creates a correction curve indicative of the correction contents of each piece of image data of K (black) and M (magenta) relating to the pixel corresponding to the nozzle of the head module 110*a* of the array (step S17).

Figure 14:
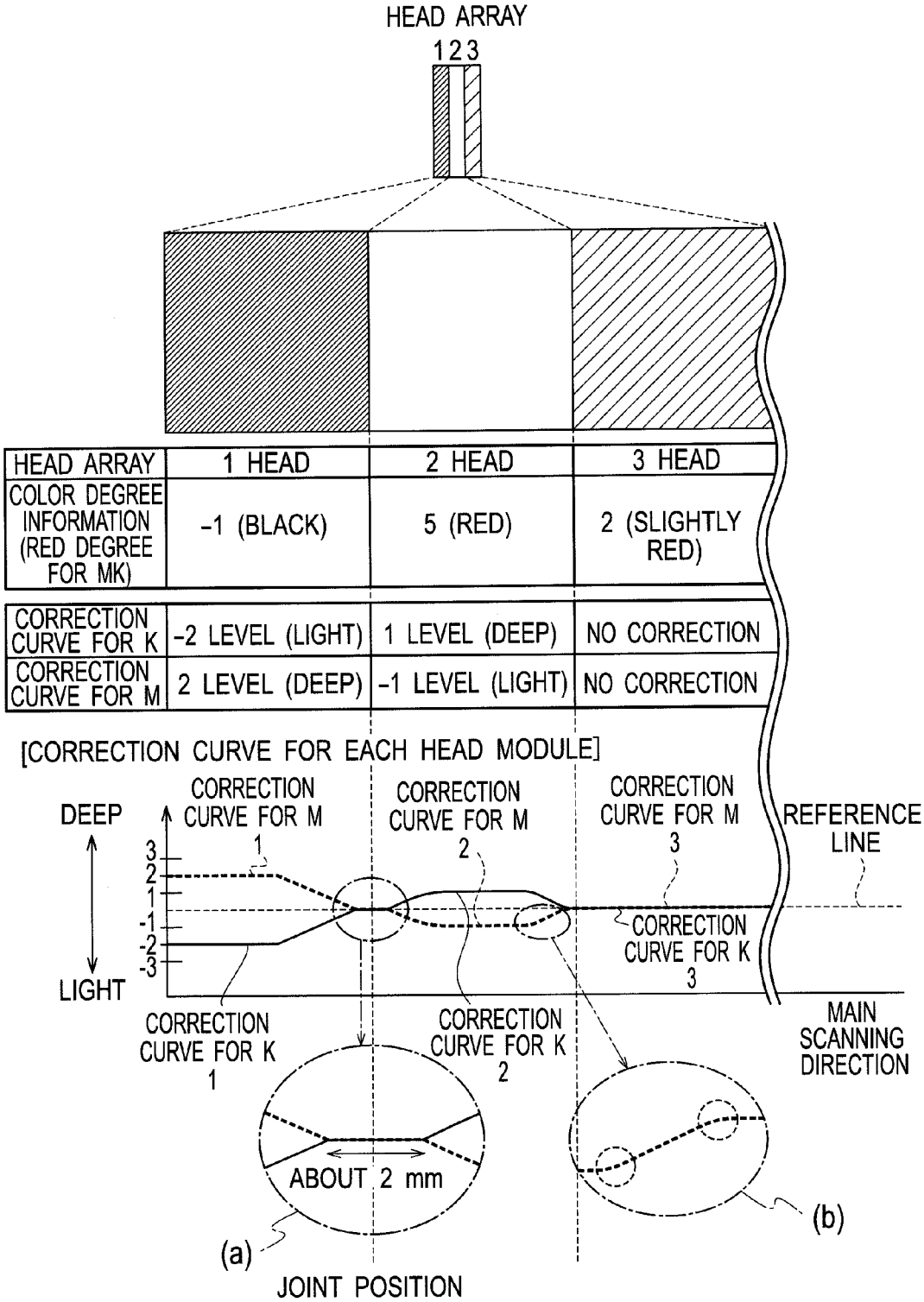
FIG. 14 is an explanatory diagram showing a procedure to create a correction curve shown in the flowchart in FIG. 13.

FIG. 14 is an explanatory diagram showing the procedure to create the correction curve in step S17 in FIG. 13. As shown in FIG. 14, the color degree (total red degree) as to K (black) and M (magenta) the client terminal 14 has received from the control unit 10 of the inkjet printer 1 is that the first array (first head) is "−1 (black)", the second array (second head) is "5 (red)", and the third array (third head) is "2 (slightly red)". In the present embodiment, a case is explained where a correction curve to match the colors of the first array and the second array with the color of "2 (slightly red)" of the third array is created.

Because of the above, it is necessary to weaken the color of black as to the image formed by dots by ink droplets discharged form the nozzle of the head module 110*a* of the first array. Therefore, the multi-valued data of K (black) of the pixel corresponding to the nozzle of the head module 110*a* of the first array is set to "−2 level (to light)" (decreased by two levels) and the multi-valued data of M (magenta) is set to "2 level (to deep)" (increased by two levels).

Similarly, it is necessary to slightly weaken the color of red as to the image formed by dots by ink droplets discharged form the nozzle of the head module 110*a* of the second array. Therefore, the multi-valued data of K (black) of the pixel corresponding to the nozzle of the head module 110*a* of the second array is set to "1 level (to deep)" (increased by one level) and the multi-valued data of M (magenta) is set to "−1 level (to light)" (decreased by one level).

On the other hand, as to the image formed by dots by ink droplets discharged from the nozzle of the head module 110*a* of the third array, it is not necessary to change the color. Therefore, as to the pixel corresponding to the nozzle of the head module 110*a* of the third array, both the multi-valued data of K (black) and the multi-valued data of M (magenta) are set to "no correction" (the level is not increased or decreased).

In the inkjet printer 1, there is a case where when the print sheet S is transferred in the transfer direction (sub scanning direction) by the platen belt 160 on the image formation path CR1, the position of the print sheet S is displaced in the print scanning direction (main scanning direction). In such a case, the CPU 90 of the control unit may change the correspondence relationship between each pixel of image data in the print job from the client terminal 14 and the nozzle of the head module 110*a* of the line head 110 of each color according to the displacement amount in the main scanning direction of the print sheet S, which is detected by a line sensor (not shown schematically) configured to detect the position of the print sheet S in the main scanning direction on the image formation path CR1.

Because of the above, there is a case where appropriate correction contents are not obtained only by determining the correction contents of multi-valued data of K (black) and M (magenta) for the pixel corresponding to the nozzle of the head module 110*a* of each array by the above-described procedure. That is, there is a case where when the print sheet S is transferred on the image formation path CR1 in the state of being displaced in the main scanning direction, multi-valued data corrected by the correction contents to be applied to the pixel corresponding to the nozzle of the head module 110*a* of the neighboring array having nothing to do with the head module 110*a* of the array of its own is used as the multi-valued data of the pixel corresponding to the nozzle of the head module 110*a* of the array of its own.

Because of the above, in the present embodiment, the CPU 16 of the client terminal 14 creates the correction curve by taking into consideration a case where the print sheet S is transferred on the image formation path CR1 in the state of being displaced in the main scanning direction. Specifically, the multi-valued data of the pixel corresponding to the nozzle near the farthest end part in the main scanning direction of the head module 110*a* of each array, which is near the boundary with the head module 110*a* of the neighboring array, is corrected by a small amount or not corrected.

That is, as shown in "correction curve for each head module" in FIG. 14, as to the multi-valued data of the pixel corresponding to the nozzle of the nozzles of the head module 110*a* of the first array (first head), which is located at the part near the boundary with the head module 110*a* of the second array (second head), the amount of change in level of the multi-valued data of K (black) and M (magenta) is made less for the pixel corresponding to the nozzle in the position nearer to the head module 110*a* of the second array. Then, as shown in FIG. 14(*a*) in an enlarged view, as to the pixel corresponding to the nozzle within a range of, for example, 2 mm from the farthest end part of the head module 110*a*, the amount of change in level of the multi-valued data is set to "0", that is, the correction of the multi-valued data is not performed.

This is the same as to the pixel corresponding to the nozzle of the nozzles of the head module 110*a* of the second array (second head), which is in the position near the head module 110*a* of the first array (first head) or near the head module 110*a* of the third array (third head), and as to the pixel corresponding to the nozzle of the nozzles of the head module 110*a* of the third array (third head), which is in the position near the head module 110*a* of the second array (second head).

Further, as shown in FIG. 14(*b*) in an enlarged view, in the part where the amount of change in level of multi-valued data changes, the amount of change in level is caused to change continuously and smoothly rather than stepwise.

It is possible to continuously use the correction curve created here unless the head module 110*a* is replaced with another etc. Consequently, it is sufficient to perform once each procedure up to step S17 in FIG. 13 unless new circumstances, such as the replacement of the head module 110*a*, occur.

Then, each time the print job is issued from the client terminal 14, the CPU 90 performs correction by the amount of change in level according to the contents of the correction curve created in step S17 in FIG. 13 for each piece of multi-valued data of K (black) and M (magenta) of the printed image generated using the printer driver capability (step S19). Then, after performing half-toning and RIP processing by a raster image processor according to the necessity, the CPU 90 transmits the data as the image data (print data) of the print job to the inkjet printer 1 (device main body) (step S21).

By performing printing of the image by the image data of the print job transmitted from the client terminal 14 in the inkjet printer 1, the same effect as that in the embodiment explained earlier can be obtained.

In the modified embodiment described above, the side of the inkjet printer 1 sets concentration information and displacement information and specifies (determines) the color degree of the image when the discharge amount of ink droplets discharged from the nozzle of the head module 110*a* of each color is not adjusted based thereon. However, it may also be possible to cause the side of the client terminal 14 to perform the processing.

Figure 15:
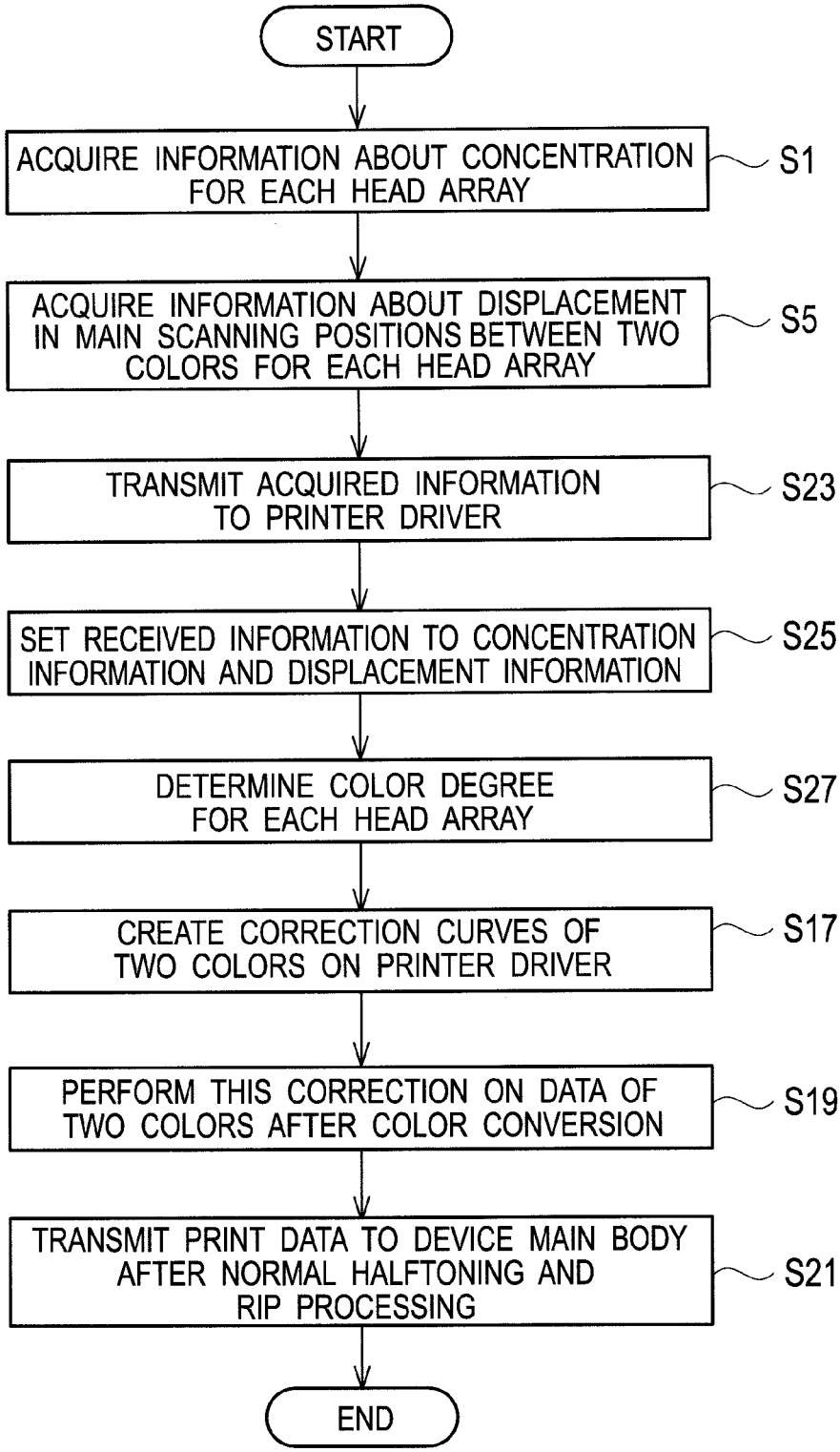
FIG. 15 is a flowchart showing another example of the procedure when part of ink droplet discharge amount adjustment processing is performed on the side of the client terminal in FIG. 8.

In such a case, as in the procedure shown in the flowchart in FIG. 15, instead of setting concentration information and displacement information in step S3 and step S7 in FIG. 13 in the control unit 10 of the inkjet printer 1, the concentration information and displacement information acquired in step S1 and step S5 in FIG. 13 are transmitted to the CPU 16 of the client terminal 14 having the printer driver capability (step S23).

Next, the CPU 16 sets the received information as concentration information and displacement information (step S25), respectively, and specifies (determines) the color degree of the image when the discharge amount of ink droplets discharged from the nozzle of the head module 110*a* of each color is not adjusted for each head module 110*a* of each array based on the set concentration information and displacement information (step S27). After that, the CPU 16 performs the procedure from step S17 to step S21 in FIG. 13.

It may also be possible to acquire each piece of information separately and set in step S25, respectively, by, for example, the input operation of the input section 19 instead of setting the concentration information and displacement information by receiving them from the inkjet printer 1.

In each of the embodiments explained above, the case is explained where acquisition and setting of concentration information, calculation of the correction voltage value of the nozzle drive signal based thereon, creation of the correction curve indicative of the amount of change in level of multi-valued data of the pixel, and the drive of the nozzle and correction of the multi-valued data based thereon are performed. However, a configuration in which those are omitted may be accepted.

In such a case, it may also be possible to confirm in advance whether or not the printing by the print job input from the client terminal 14 is monochrome printing in step S13 in the flowchart in FIG. 9 and to drive the nozzle by the drive signal of the correction voltage value calculated in step S11 only when the printing is not monochrome printing.

Similarly, it may also be possible to confirm in advance whether or not the printing by the print job issued from the client terminal 14 is monochrome printing in step S19 in FIG. 13 and FIG. 15 and to perform correction of the multi-valued data to which the correction curve created in step S17 has been applied only when the printing is not monochrome printing.

By doing so, only the ink droplet of one color lands on the same pixel and it is possible to prevent the ink droplet discharge amount from being corrected unnecessarily in monochrome printing in which a change in color due to the displacement in dot position does not occur.

Further, such a configuration may be accepted in the embodiment and the modified example described above, in which when determining the correction contents, the difference in concentration of dots formed on the print sheet respectively by the ink droplets of the same color discharged from the nozzles of the head module of each array respectively is not expanded compared to that before the correction of the ink droplet discharge amount.

By doing so, it is possible to prevent the difference in concentration between head module arrays of dots by the ink droplets of the same color from being expanded by correcting the ink droplet discharge amount in order to suppress the change in color in the image due to the displacement present between dots of each color of the same pixel. Due to this, it is possible to prevent the difference in color of the image resulting from the difference in concentration between dots of the same color from being expanded between each pixel corresponding to the head module of each array.

As obvious from the above explanation, according to the present invention, it is possible to effectively suppress the change in color of an image resulting from the configuration in which the line head of each color is configured by a plurality of head modules in a line inkjet printer.

The present application claims the benefit of priority under 35 U.S.C. §119 to Japanese Patent Application No. 2010-213892, filed on Sep. 24, 2010, the entire content of which is incorporated herein by reference.

What is claimed is:

1. An ink discharge amount adjuster for each color of a line inkjet printer, comprising:

a plurality of line heads which includes head modules arranged side by side in a plurality of arrays in a print scanning direction intersecting a transfer direction of a print sheet and which is configured to discharge ink droplets of a color different for each line head from a number of nozzles provided in each head module of each line head;

a displacement information setter in which displacement information indicating a displacement amount of a head module in the print scanning direction resulting in displacement of dots of each color formed on the same pixel of the print sheet respectively by ink droplets of each color discharged from a nozzle of the head module of each line head is set for each of the head modules of each line head arranged in the same array in the transfer direction;

a correction contents determiner configured to determine, for each color, correction contents of a drive condition for adjusting a discharge amount per ink droplet discharged respectively from the nozzle of the head module of each line head arranged in the same array in order to reduce a color difference between each array of dots formed respectively on each pixel of the print sheet based on the displacement information set in the displacement information setter, the drive condition for adjusting a discharge amount per ink droplet is the same within each head module; and a discharge amount corrector configured to correct the discharge amount of ink droplets from the nozzle of the head module of each line head arranged in the same array based on the correction contents determined for each color by the correction contents determiner.

2. The ink discharge amount adjuster for each color of a line inkjet printer according to claim 1, wherein the correction contents determiner determines the correction contents so that a concentration difference of dots formed on the print sheet respectively by ink droplets of the same color discharged respectively from a nozzle of each head module of each line head is not expanded compared to a concentration difference of dots before the correction of the discharge amount of ink droplets by the discharge amount corrector.

3. The ink discharge amount adjuster for each color of a line inkjet printer according to claim 1, wherein the discharge amount corrector has a monochrome ink detector, the monochrome ink detector prohibits the discharge amount corrector from performing correction when the monochrome ink detector detects printing by a monochrome ink based on a print job.

4. The ink discharge amount adjuster for each color of a line inkjet printer according to claim 1, further comprising:

a concentration information setter in which concentration information indicating the concentration of dots of each color for on the same pixel of the print sheet respectively by ink droplets of each color discharged from a nozzle of each head module of each line head is set for each of the head modules of each line head arranged in the same array, wherein the correction contents determiner further determines the correction contents so that the color comes close to the color of each pixel when the concentration difference of dots of each color formed respectively on the same pixel indicated by the concentration information set in the concentration information setter is zero.

5. The ink discharge amount adjuster for each color of a line inkjet printer according to claim 1, further comprising, a boundary corrector that corrects image data of a pixel corresponding to a nozzle arranged in the boundary region between two adjacent arrays of head modules in the transfer direction of each line head in such a manner that the correction is performed with a smaller amount of change in level of multi-valued data for a pixel corresponding to a nozzle closer to the boundary between the head modules.

6. The ink discharge amount adjuster for each color of a line inkjet printer according to claim 5, wherein the amount of change in level of multi-valued data for a pixel corresponding to a nozzle closer the boundary between the head modules becomes zero.

* * * * *